United States Patent [19]

Seely

[11] Patent Number: 4,512,094

[45] Date of Patent: Apr. 23, 1985

[54] PLASTIC POSTER FRAME WITH ARTICULATED BIAS MEMBER

[75] Inventor: James R. Seely, Rochester, Mich.

[73] Assignee: Marketing Displays, Inc., Farmington Hills, Mich.

[21] Appl. No.: 499,441

[22] Filed: Jun. 6, 1983

Related U.S. Application Data

[63] Continuation-in-part of Ser. No. 448,047, Dec. 8, 1982, abandoned, which is a continuation-in-part of Ser. No. 424,883, Sep. 27, 1982, abandoned.

[51] Int. Cl.[3] ..... A47G 1/06

[52] U.S. Cl. ..... 40/156; 40/13

[58] Field of Search ..... 40/156, 13; 24/67.3, 24/67.7, 292; 52/400; 16/225, 227, 277

[56] References Cited

U.S. PATENT DOCUMENTS

| | | | |
|---|---|---|---|
| 2,603,017 | 7/1952 | Merrill | 40/152 |
| 2,882,633 | 4/1959 | Howell | 40/156 |
| 3,070,914 | 1/1963 | Henderson et al. | 40/156 |
| 3,205,601 | 9/1965 | Gawne et al. | 40/156 |
| 3,310,901 | 3/1967 | Sarkisian | 40/156 |
| 3,360,893 | 1/1968 | Wattelez | 52/105 |
| 3,386,198 | 6/1968 | Howell | 40/156 |
| 3,720,979 | 3/1973 | Krawagna | 16/227 |
| 4,038,770 | 8/1977 | Bott | 40/209 |
| 4,145,828 | 3/1979 | Hillstrom | 40/156 |
| 4,237,632 | 12/1980 | Segerstad | 40/156 |
| 4,358,917 | 11/1982 | Oda | 52/717 |
| 4,364,192 | 12/1982 | Lloyd | 40/155 |

FOREIGN PATENT DOCUMENTS

| | | | |
|---|---|---|---|
| 835010 | 2/1970 | Canada | 16/225 |
| 1295378 | 11/1972 | United Kingdom . | |
| 005535A | 4/1979 | United Kingdom . | |

*Primary Examiner*—Robert P. Swiatek
*Assistant Examiner*—Cary E. Stone
*Attorney, Agent, or Firm*—Harness, Dickey & Pierce

[57] ABSTRACT

A plastic poster frame and display holder for replaceable posters, pictures and similar advertising or decorative material has extruded frame forming sections comprising hingedly connected front and back parts. A relatively resilient elongated plastic portion is integrally formed as part of the frame section and provides a biased clamping force for holding a poster of similar display between the hinged parts.

66 Claims, 22 Drawing Figures

PLASTIC POSTER FRAME WITH ARTICULATED BIAS MEMBER

This application is a continuation-in-part of application Ser. No. 448,047, filed Dec. 8, 1982, entitled "Spring-Loaded Poster Frame" now abandoned which in turn is a continuation-in-part of application Ser. No. 424,883, filed Sept. 27, 1982, entitled "Spring-Loaded Poster Frame" now abandoned.

BACKGROUND—SUMMARY OF THE INVENTION

The present invention relates to an improved poster frame and display holder for various types of replaceable posters, pictures and similar advertising materials. The frame and holder can be used in many various areas, such as on buses, taxi cabs, and similar mobile installations, as well as on fixed mounts such as on building walls at service stations, on posts and the like. The poster display device is neat, trim and aesthetic and capable of being used either indoors or outdoors. The device secures a poster or other message sign within its borders and allows replacement thereof in a quick and easy manner.

The present invention is an improvement over the invention disclosed and claimed in U.S. Pat. No. 4,145,828 and assigned to the assignee of the present invention. In that patent a display holder is set forth having a plurality of frame sections. Each of the sections are made essentially of two extruded portions which are pivoted together, the extruded portions being of any material which can be economically extruded, such as aluminum. The extruded frame sections are biased by means of an unbent metal leaf spring to coact and to releasably clamp posters or similar display items in the frame. The invention as disclosed and claimed in U.S. Pat. No. 4,145,828 was itself an improvement over U.S. Pat. No. 3,310,901 which employed cantilever action-type metal leaf springs with S-shaped hooks at one end to bias together the two parts of the frame.

The present invention provides a poster frame and display holder which is less expensive to manufacture and lighter in weight than the poster frames described in the above named patents. The poster display device of the present invention also is made from a plastic material, is essentially one-piece, and is capable of providing economical frames with relatively small widths (e.g. one-half inch or smaller). In the present device a plurality of frame sections forming a polygonal frame structure are extruded of a plastic material. In the preferred embodiment each frame section comprises a one piece extrusion having a front portion and a back portion of relatively rigid plastic material adapted to be hingedly connected to one another, and having an elongated biasing section of relatively resilient plastic material forming an integral part of the frame section. The front portion has an outwardly facing surface on which a decorative simulated metal or simulated wood laminate can be secured. The back portion is formed with an upstanding flange having a pivot pintle formation thereon. The front portion is formed with an inwardly directed flange at a first end thereof and with a second inwardly directed flange at a second end thereof which includes a cup shaped formation adapted to engage the pivot pintle on the back portion and form a hinge. The elongated biasing section is coupled between the downwardly directed front flange and the upstanding flange, and forms an integral part of the one piece extrusion. The length of the elongated biasing member is such that when the pivot pintle and cup shaped formation are joined to form a hinge, the biasing member is placed under compression causing it to bow towards the front portion. The biasing member thus provides clamping forces between the front and back portion. In one preferred embodiment the resilient biasing section includes living hinges disposed intermediately along the length thereof which facilitate changing or removing posters.

In another preferred embodiment the extruded member serves to clamp the display piece in place from the back side of the display piece against a separate frame member.

It is an object of the present invention to provide a unique and beneficial poster frame and display holder for use in various applications. It is another object to provide a highly durable, weather resistant poster frame and display holder which can be used indoors and outdoors and which will provide a reliable and pleasing appearance throughout its lifetime. Yet another object is to provide a display holder and poster frame which can be economically manufactured from relatively inexpensive materials.

Still another object is to provide a poster display framing device which retains the effective clamping action of the inventions of U.S. Pat. Nos. 3,310,901 and 4,145,828, and yet which can be made more economically in smaller sizes.

Other objects, features, and advantages of the invention will become apparent from the following description of the invention when viewed in accordance with the accompanying drawings.

DESCRIPTION OF THE PREFERRED EMBODIMENTS

Figure 1:
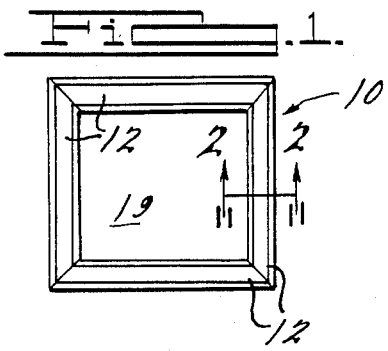
FIG. 1 is a front view of an improved display holder in accordance with the invention.
Figure 2:
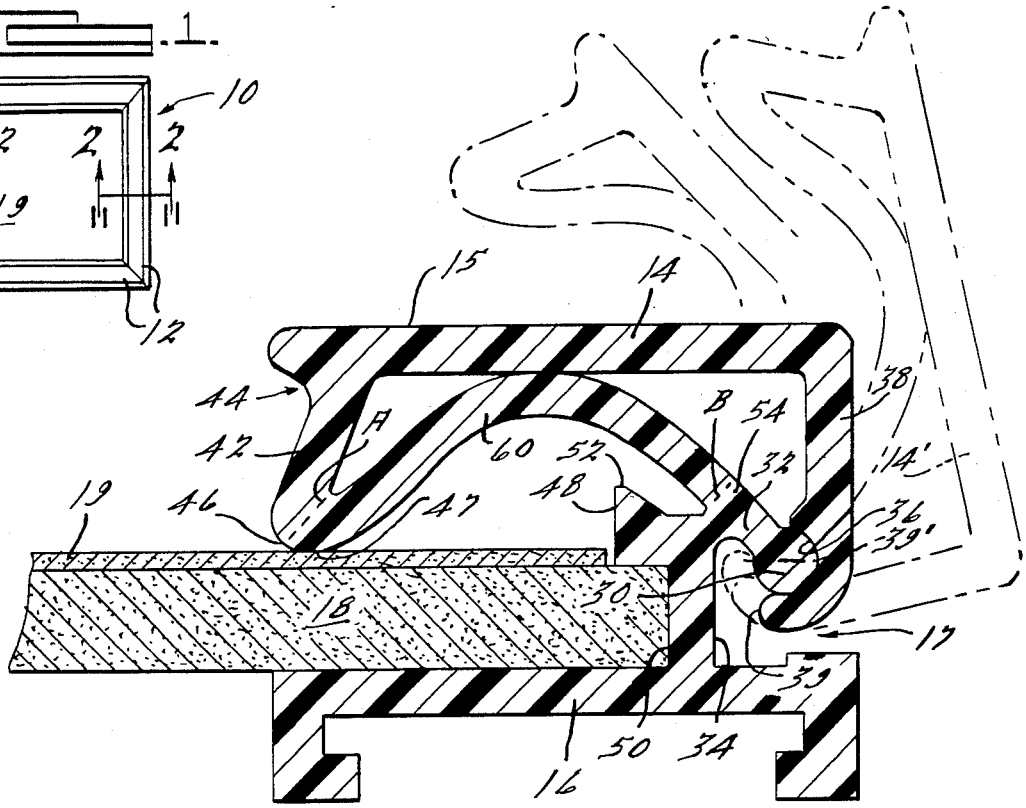
FIG. 2 is a cross sectional view taken along the line 2—2 in FIG. 1.

As illustrated in FIG. 1, the improved display holder and poster frame, generally designated by the reference numeral 10, is made up of a plurality of frame sections 12. For a square or rectangular-shaped poster, four frame sections 12 are normally provided. The frame sections are mitered 45 degrees at their ends and fastened together to form a box-type frame. A backing member of hardboard, fiberboard, or metal is provided and the frame is secured on or around its edge forming the complete poster framing device. As shown in FIG. 2, each of the sections 12 is made essentially of two portions 14 and 16 being part of a common extrusion which are pivoted together as at 17. The portions 14 and 16 of each section 12 are cut to the desired length and mitered 45 degrees at their opposite ends for abutting and coplanar assembly with one another to outline the frame 10. As will be understood, the frame 10 can be square or rectangular, although it is also possible for the frame 10 to have any desired polygonal shape with an appropriate number of sections 12 mitered at appropriate angles. Also, it is possible for each of the front or cover extrusions 14 to be comprised of a number of extruded pieces of shorter length.

The frame 10 preferably has associated with it a rigid backing member 18 which can be made of plastic, masonite, aluminum or another suitable material. The sections 12 are positioned around the edges of the backing member 18 and held in place around its edges by the sections 12 as with pop rivets, for example, to form the completed display holder. A poster 19 or other display member is positioned on the backing member 18. The back extruded portion 16 can be fastened in any conventional means to a rigid or supporting member, such as a post, wall, support frame for a vehicle, or the like. It is also understood that the use of a backing member 18 is not necessary; the frame 10 could be mounted on a flat surface forming its own backing member, or the poster 19 could be made of a rigid or stiff material without the need for a backing member.

The portions 14 and 16 are preferably made of a plastic material which can be efficiently and economically extruded, and which will present an attractive and durable structure for an indefinite length of time. Suitable materials include polypropylene, vinyl, and rigid polyvinyl chloride.

Adjacent sections 12 of the frame are held and fastened together as by glueing section to section, by glueing to the backing member 18, or by means of L-shaped corner braces as taught in U.S. Pat. No. 3,310,901, the disclosure of which is incorporated herein by reference. The outer or front portion 14 of each frame section is formed with a decorative outer surface 15 and is assembled to the back portion 16 by means of a hinge assembly denoted generally by reference numeral 17. The outer surface 15 preferably is relatively flat, but can have any decorative or ridged surface. If it is relatively flat, then it is easier to apply a simulated metal (e.g. Mylar) or simulated wood laminate to it.

The hinge assembly is comprised of a cylindrical hinge or pivot pintle formation 30 extending outwardly by bridge element 32 from an upstanding flange 34 disposed on back portion 16 and a corresponding cup shaped formation 36 formed on the back panel 38 of portion 14. The edges of the cup 36 may extend more than 180 degrees about the pivot 30 in which case the two sections 14 and 16 are snapped together after extrusion to form hinge assembly 17. The edges of cup 36 may alternatively extend less than 180 degrees about the pivot 30 to form hinge assembly 17. As shown by dashed outlines of FIG. 2, the hinge assembly 17 allows the cover portion 14 to pivot relative to the back portion 16. When the cover portion 14 is in the position shown in solid lines in FIG. 2, it holds the poster 19 in position in the frame against the backing member 18. When it is desired to remove or replace the poster 19, the cover portion 14 is rotated or pivoted to the dashed outline position 14' permitting the removal of the poster. The rotation of portion 14 is limited by stop end 39 of cup shaped formation 36; when the portion 14 is swung to its fully open position (14') the end 39 rests against bridge element 32 (as shown by dashed outline position 39' in FIG. 2).

Extruded portion 14 has a formed side panel or flange 42 thereon with a longitudinal recess 44 formed in it. The recess 44 is provided so that the portion 14 may be grasped in manipulation to open or close it relative to portion 16. The end 46 of side panel 42 is adapted to rest on the poster 19 and clamp it in place in the display holder.

The upstanding flange 34 is formed with a lip 48 projecting orthogonally inwardly towards the center of frame 10. The upstanding flange and lip 48 form a recess 50 adapted to engage the backing member 18 around its outer edge hiding any rough edges of the backing member. Lip 48 terminates with an ear 52 which provides a stop surface or guide surface useful for positioning the poster 19 and keeping it from going too far into the frame. The bridge 32 is attached to upstanding flange 34 and projects generally outwardly from the center of frame 10, forming a downwardly directed dogleg and terminating in pivot pintle 30. Bridge element 32 includes a knee portion 54 disposed generally opposite to the pivot pintle 36.

It will be understood that the structure thus described is extruded of a relatively rigid plastic material such as a vinyl material, including polyvinyl chloride. The invention also comprises an elongated biasing or spring portion denoted generally by reference numeral 60, which is extruded of a relatively resilient material such as estane polyurethane, or of a softer vinyl material. The elongated biasing portion 60 is integral with and coupled generally between the end 46 of side panel 42 and knee portion 54. The union between biasing portion 60 and end 46 forms a transition A between the relatively rigid material of side panel 42 and the relatively resilient, flexible material of biasing portion 60. The union between biasing portion 60 and the knee 54 of bridge 32 forms a transition B between the relatively rigid bridge and the relatively resilient, flexible biasing portion. Preferably the unions forming transitions A and B are formed during the extrusion process, in other words, the biasing portion 60 is of the same one piece extrusion which forms the front part 14 and the back part 16. If desired, transition A may be formed, as shown in FIG. 2, so that corner 47 (which contacts poster 19 when the frame is closed) is of the softer material of biasing portion 60. This provides more friction between corner 47 and poster 19 to hold poster 19 in place.

Figure 2A:
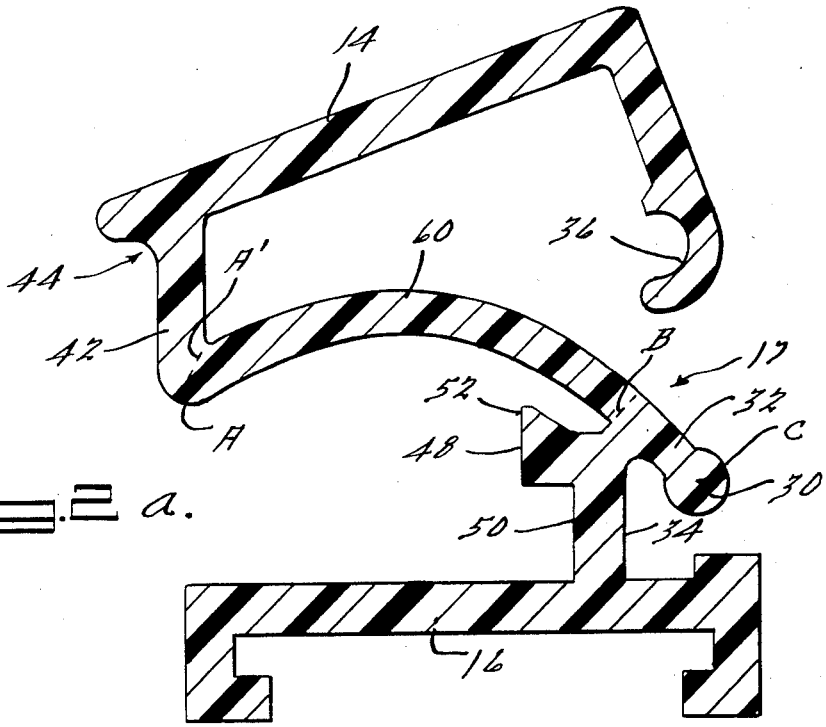
FIG. 2*a* is a cross sectional view of the embodiment of FIG. 2 showing hinge member disassembled.

FIG. 2*a* shows the one piece extrusion before hinge 17 is assembled. As can be seen, the frame section is extruded with the front and rear portions essentially in their open positions, but without the pivot pintle formation 30 and cup shaped formation 36 being nested together. The biasing portion 60 is extruded in a slightly bowed or arcuate configuration, although it can also be extruded in an essentially flat configuration. The running length of biasing portion 60 and bridge 32, as measured from a central point A' along interface A to point C at the center of pivot pintle 30, is made longer than the linear distance between point A' and point C. Thus when hinge 17 is assembled by snapping the cup shaped formation 36 onto the pivot pintle formation 30, the biasing portion 60 is caused to bow inwardly towards the frame front portion 14 a significant extent (or further if extruded in a slightly bowed condition), as shown in FIG. 2. This shortens the radius of curvature of portion 60 causing it to exert an inward and outward over-center force to stably retain the movable frame front portion 14 in either its closed or its open positions. In either position, the biasing portion 60 urges the front extrusion 14 in a direction to maintain its integral cup shaped hinge formation 36 snugly against the integral pintle formation 30 of the back extrusion 16.

Figure 5:
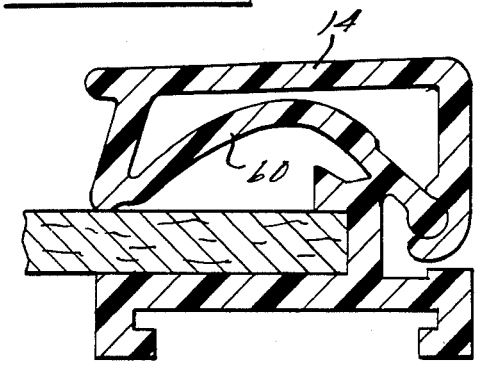
FIGS. 5 through 10 illustrate the invention in operation.
Figure 6:
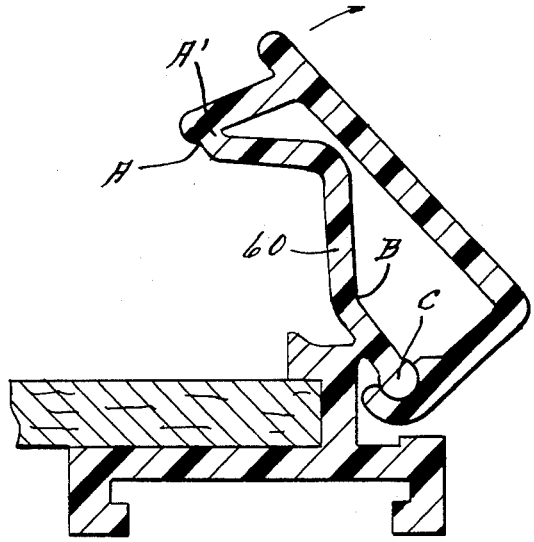

Referring to FIGS. 5 through 10, the spring action of biasing portion 60 is illustrated over a typical operating range. In FIG. 5 the frame section is shown without a poster clipped in place. The biasing portion 60 is bowed inwardly towards the frame front portion 14. As explained above this inward bowing causes biasing portion 60 to exert forces on the front portion 14 urging it into its closed position. In FIG. 6 the front portion 16 is shown being rotated towards the open position shown in FIG. 7. As the frame is being opened the biasing portion 60 becomes even more significantly bowed with an even shorter radius of curvature, as shown in FIG. 6. This increased bowing may be accounted for by noting that the linear distance between the ends of biasing portion 60 as at A and B has decreased (compressing biasing portion 60) as the point A' follows its rotational trajectory about the point C. In the position shown by FIG. 6 the biasing portion 60 continues to exert a downward force tending to close the frame.

Figure 7:
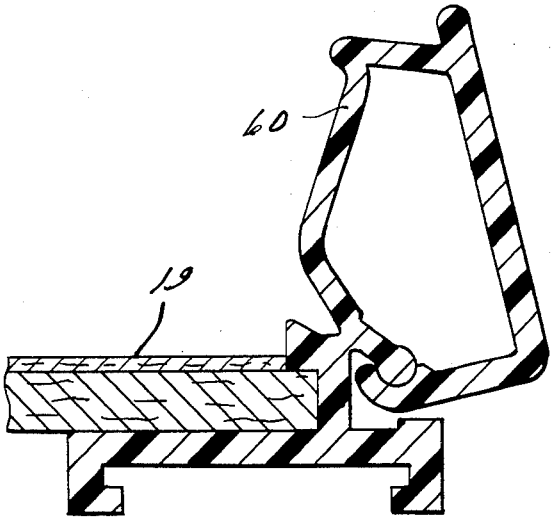

At some point at or near the frame's open position, biasing portion 60 snaps into an outwardly bowed position, as shown in FIG. 7. In the outwardly bowed position, biasing portion 60 exerts forces tending to hold front portion 14 in its relatively open position, thereby permitting poster 19 or the like to be positioned within the frame.

Figure 8:
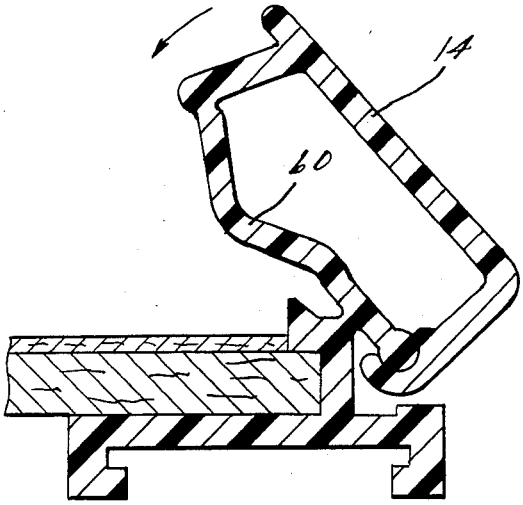
Figure 9:
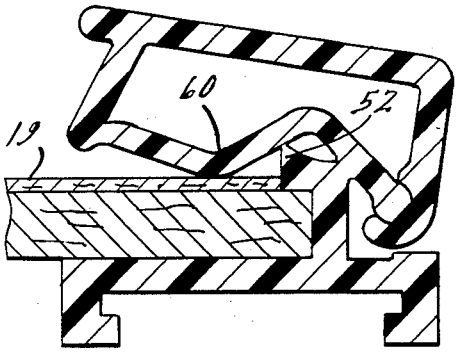
Figure 10:
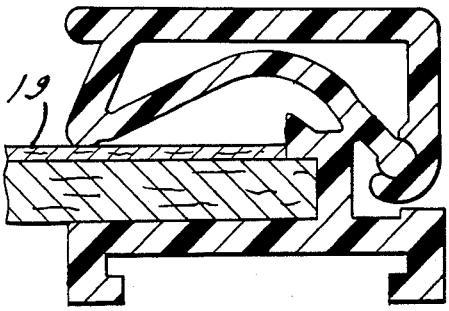

The closing sequence is shown in FIGS. 8 through 10. As the front portion 14 is manually rotated towards the closed position against the biasing forces, biasing portion 60 becomes more significantly outwardly bowed. Further rotation towards the closed position, shown in FIG. 9, causes more significant bowing of biasing portion 60. In FIG. 9 it will be seen that biasing portion 60 becomes somewhat S-shaped in longitudinal cross section. At some point at or near the final closed position, shown in FIG. 10, biasing portion 60 snaps back into its inwardly bowed position. When this occurs the biasing forces produced by biasing portion 60 tend to hold the frame in its closed position, thereby clamping poster 19 in place. With particular reference to FIG. 9 it will be seen that biasing portion 60 is capable of contacting ear 52, and possibly also poster 19. Such contact, although not essential or required, can provide an impetus or motive for biasing portion 60 snapping back into the inwardly bowed position of FIG. 10.

Figure 3:
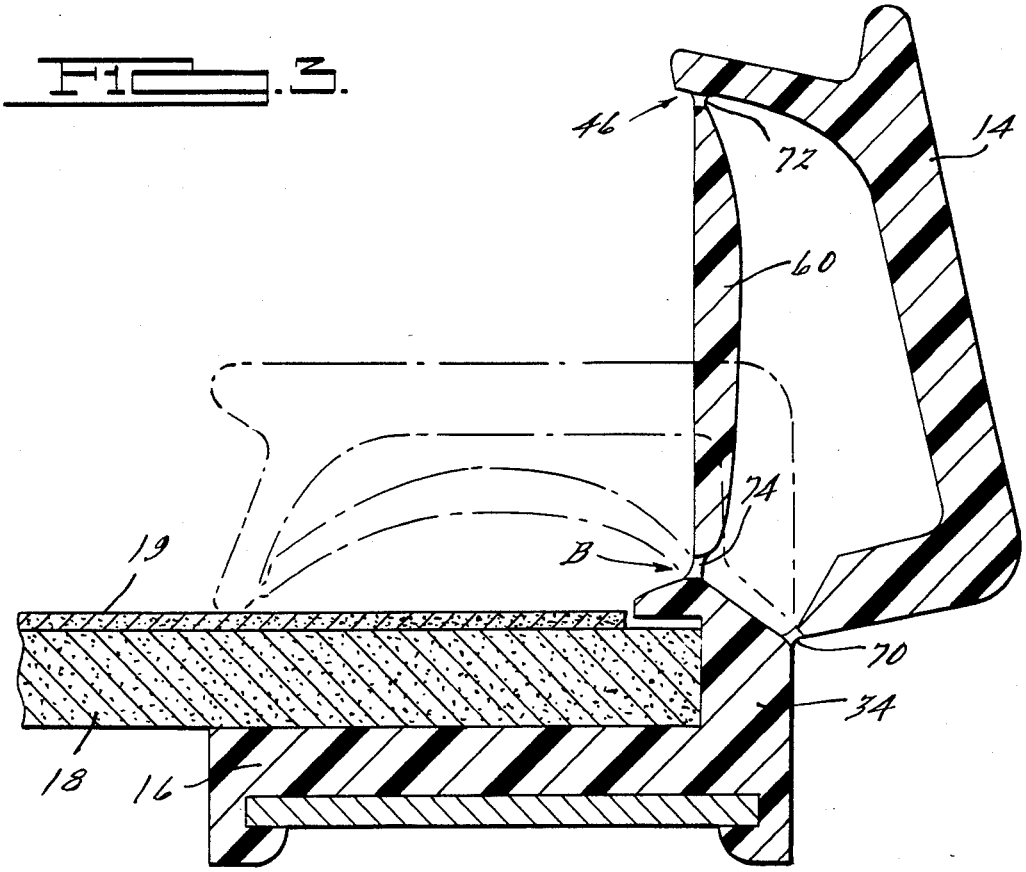
FIG. 3 is a cross sectional view of another embodiment of the invention.

Another embodiment of the invention is shown in FIG. 3. In this embodiment the biasing portion 60, as well as the front portion 14 and back portion 16, are extruded of relatively rigid plastic. Again the frame section components are extruded in their "open" position as shown in solid lines. The front portion 14 and back portion 16 are joined with a flexible living hinge 70 made of a thinner portion of the plastic material. Likewise, the biasing portion 60 is coupled to the end 46 of front piece 42 by means of a second flexible living hinge 72, and coupled to the upstanding flange 34, as at B, by means of yet another flexible living hinge 74. Preferably, all of the three living hinges are made of the same material. Whether the biasing portion 60 is made from a rigid or soft material, it functions as in the first embodiment to exert an inward and outward over-center force to stably retain the moveable frame section portions in either their closed or open positions.

It will also be appreciated that in this embodiment of FIG. 3 the living hinge 70 may alternatively be replaced with the pivot pintle and integral cup shaped formation as described in connection with the first embodiment. The living hinges 72 and 74 would remain, however, at the connection of the biasing portion to the front piece 42 and to the upstanding flange 34.

Figure 4:
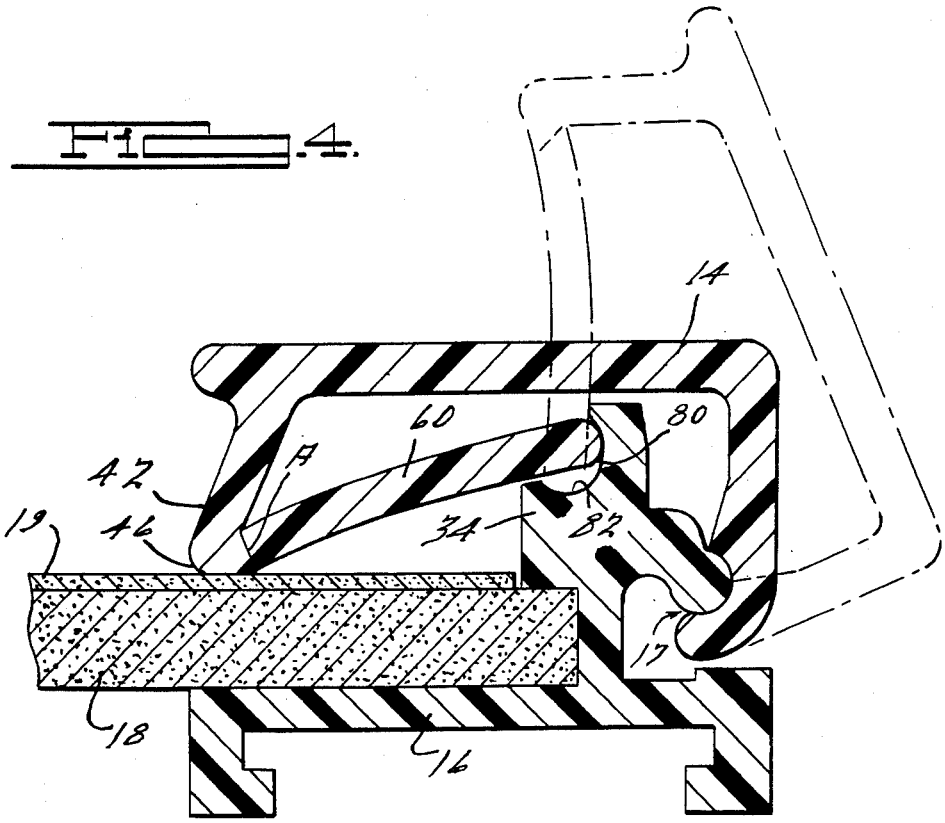
FIG. 4 is a cross sectional view of yet another embodiment of the invention.

Still another embodiment is shown in FIG. 4. This embodiment employes the pivoting hinge mechanism 17 of the first embodiment and is extruded as two pieces, although the living hinge 70 of the second embodiment may be substituted for the hinge mechanism 17 in which case a one piece extrusion would be used. The biasing portion 60 is coupled as at A to the end 46 of side panel 42 and is extruded of semi rigid plastic material forming an integral part of the front extrusion. The biasing or spring portion 60 as extruded is slightly arcuate and terminates in a free standing rounded end portion 80. The upstanding flange 34 is formed with a longitudinal, arc shaped groove 82 adapted to pivotally engage end portion 80 upon assembly. The arcuate portion of groove 82 extends approximately 90 degrees and is positioned to allow movement of the end 80 of biasing section 60 over a 90 degree arc as the cover portion 14 is opened and closed, while preventing the end 80 from being displaced therefrom. Thus the biasing portion 60 exerts an inward and outward over-center force to stably retain the moveable frame section portion in either its closed or its open position.

Figure 11:
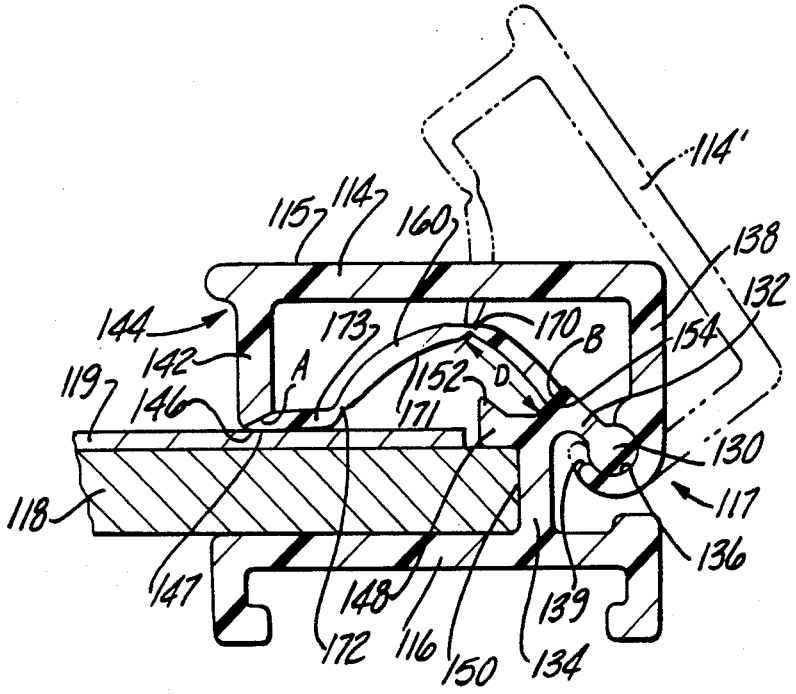
FIG. 11 is a cross sectional view of a further embodiment of the invention.

Another embodiment, illustrated in FIGS. 11 through 18, employs living hinges disposed intermediately along the length of the elongated biasing section to facilitate changing or removing posters by providing a more positive snapping action. As shown in FIG. 11, each of the frame sections 112 is made essentially of two portions 114 and 116 being part of a common extrusion which are pivoted together as at 117. The portions 114 and 116 of each section 112 are cut to the desired length and mitered 45 degrees at their opposite ends for abutting and coplanar assembly with one another to outline the frame. As will be understood, the frame can be square or rectangular, although it is also possible for the frame to have any desired polygonal shape with an appropriate number of sections 112 mitered at appropriate angles. Also, it is possible for each of the front or cover extrusions 114 to be comprised of a number of extruded pieces of shorter length.

The frame preferably has associated with it a rigid backing member 118 which can be made of plastic, masonite, aluminum or another suitable material. The sections 112 are positioned around the edges of the backing member 118 and held in place around its edges by the sections 112 as with pop rivets, for example, to form the completed display holder. A poster 119 or other display member is positioned on the backing member 118. The back extruded portion 116 can be fastened in any conventional means to a rigid or supporting member, such as a post, wall, support frame for a vehicle, or the like. It is also understood that the use of a backing member 118 is not necessary; the frame could be mounted on a flat surface forming its own backing member, or the poster 119 could be made of a rigid or stiff material without the need for a backing member.

The portions 114 and 116 are preferably made of a plastic material which can be efficiently and economically extruded, and which will present an attractive and durable structure for an indefinite length of time. Suitable materials include polypropylene, vinyl, and rigid polyvinyl chloride.

Adjacent sections 112 of the frame are held and fastened together as by glueing section to section, by glueing to the backing member 118, or by means of L-shaped corner braces as taught in U.S. Pat. No. 3,310,901, the disclosure of which is incorporated herein by reference. The outer or front portion 114 of each frame section is formed with a decorative outer surface 115 and is assembled to the back portion 116 by means of a hinge assembly denoted generally by reference numeral 117. The outer surface 115 preferably is relatively flat, but can have any decorative or ridged surface. If it is relatively flat, then it is easier to apply a simulated metal (e.g. Mylar) or simulated wood laminate to it.

The hinge assembly is comprised of a cylindrical hinge or pivot pintle formation 130 extending outwardly by bridge element 132 from an upstanding flange 134 disposed on back portion 116 and a corresponding cup shaped formation 136 formed on the back panel 138 of portion 114. The edges of the cup 136 may extend more than 180 degrees about the pivot 130 in which case the two sections 114 and 116 are snapped together after extrusion to form hinge assembly 117. The edges of cup 136 may alternatively extend less than 180 degrees about the pivot 130 to form hinge assembly 117. As shown by dashed outlines of FIG. 11, the hinge assembly 117 allows the cover portion 114 to pivot relative to the back portion 116. When the cover portion 114 is in the position shown in solid lines in FIG. 11, it holds the poster 119 in position in the frame against the backing member 118. When it is desired to remove or replace the poster 119, the cover portion 114 is rotated or pivoted to the dashed outline position 114' permitting the removal of the poster. The rotation of portion 14 is limited by stop end 139 of cup shaped formation 136; when the portion 114 is swung to its fully open position (114') the end 139 rests against bridge element 132 (as shown by dashed outline position 139' in FIG. 2).

Extruded portion 114 has a formed side panel or flange 142 thereon with a longitudinal recess 144 formed in it. The recess 144 is provided so that the portion 114 may be grasped in manipulation to open or close it relative to portion 116. The end 146 of side panel 142 is adapted to rest on the poster 119 and clamp it in place in the display holder.

The upstanding flange 134 is formed with a lip 148 projecting orthogonally inwardly towards the center of frame. The upstanding flange and lip 148 form a recess 150 adapted to engage the backing member 118 around its outer edge. Lip 148 terminates with an ear 152 which provides a stop surface or guide surface useful for positioning the poster 119. The bridge 132 is attached to upstanding flange 134 and projects generally outwardly from the center of frame, forming a downwardly directed dogleg and terminating in pivot pintle 130. Bridge element 132 includes a knee portion 154 disposed generally opposite to the pivot pintle 136.

It will be understood that the structure thus described is extruded of a relatively rigid plastic material such as a vinyl material, including polyvinyl chloride. The invention also comprises an elongated biasing or spring portion denoted generally by reference numeral 160, which is extruded of a relatively resilient material such as estane polyurethane, or of a softer vinyl material. The elongated biasing portion 160 is integral with and coupled generally between the end 146 of side panel 142 and knee portion 154. The union between biasing portion 160 and end 146 forms a transition A between the relatively rigid material of side panel 142 and the relatively resilient, flexible material of biasing portion 160. The union between biasing portion 160 and the knee 154 of bridge 132 forms a transition B between the relatively rigid bridge and the relatively resilient, flexible biasing portion. Preferably the unions forming transitions A and B are formed during the extrusion process, in other words, the biasing portion 160 is of the same one piece extrusion which forms the front part 114 and the back part 116. If desired, transition A may be formed, as shown in FIG. 11, so that corner 147 (which contacts poster 119 when the frame is closed) is of the softer material of biasing portion 160. This provides more friction between corner 147 and poster 119 to hold poster 19 in place.

Biasing portion 160 is formed with living hinge 170 located intermediate along the length of portion 160 at a distance D from transition B; where D is less than 50% and preferably approximately 20%–40% of the length of biasing portion 160. A second living hinge 172 is formed in portion 160 approximately adjacent transition A, coupling intermediate portion 171 of biasing portion 160 to end portion 173 thereof and to side portion 142. Living hinge 170 ensures that biasing portion 160 bows outwardly when the frame is opened, as will be understood with reference to FIG. 15. Living hinge 172 coacts with hinge 170 to further ensure that the biasing portion 160 bows outwardly when opened. Hinge 172 is disposed apart from transition A to minimize the tendency for the members at transition A to separate.

Figure 12:
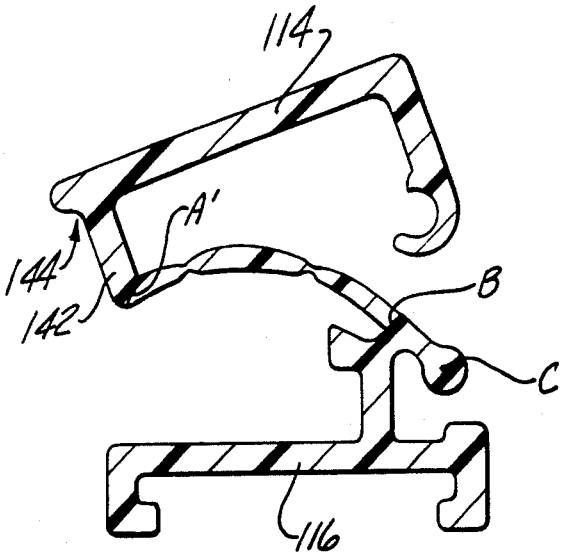
FIG. 12 is a cross sectional view of the embodiment of FIG. 11 showing hinge member disassembled.

FIG. 12 shows the one piece extrusion before hinge 117 is assembled. As can be seen, the frame section is extruded with the front and rear portions essentially in their open positions, but without the pivot pintle formation 130 and cup shaped formation 136 being nested together. The biasing portion 160 is extruded in a slightly bowed or arcuate configuration, although it can also be extruded in an essentially flat configuration. The running length of biasing portion 160 and bridge 132, as measured from a central point A' along interface A to point C at the center of pivot pintle 130, is made longer than the linear distance between point A' and point C. Thus when hinge 117 is assembled by snapping the cup shaped formation 136 onto the pivot pintle formation 130, the biasing portion 160 is caused to bow inwardly towards the frame front portion 114 a significant extent (or further if extruded in a slightly bowed condition), as shown in FIG. 11. This shortens the radius of curvature of portion 160 causing it to exert an inward and outward over-center force to stably retain the movable frame front portion 114 in either its closed or its open positions. In either position, the biasing portion 160 urges the front extrusion 114 in a direction to maintain its integral cup shaped hinge formation 136 snugly against the integral pintle formation 30 of the back extrusion 116.

Figure 13:
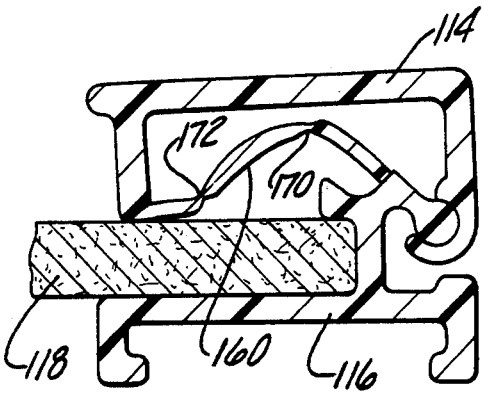
FIGS. 13–18 illustrate the invention of FIG. 11 in operation.
Figure 14:
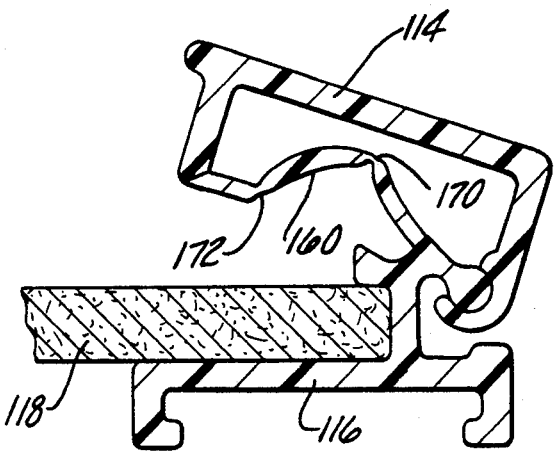

Referring to FIGS. 13 through 18, the spring action of biasing portion 160 is illustrated over a typical operating range. In FIG. 13 the frame section is shown without a poster clipped in place. The biasing portion 160 is bowed inwardly towards the frame front portion 114. As explained above this inward bowing causes biasing portion 160 to exert forces on the front portion 114 urging it into its closed position. In FIG. 14 the front portion 116 is shown being rotated towards the open position shown in FIG. 15. As the frame is being opened the biasing portion 160 becomes even more significantly compressed or bowed with an even shorter radius of curvature, as shown in FIG. 14. This increased bowing may be accounted for by noting that the linear distance between the ends of biasing portion 160 as at A and B has decreased (compressing biasing portion 160) as the point A' follows its rotational trajectory about the point C. In the position shown by FIG. 14 the biasing portion 160 continues to exert a downward force tending to close the frame.

Figure 15:
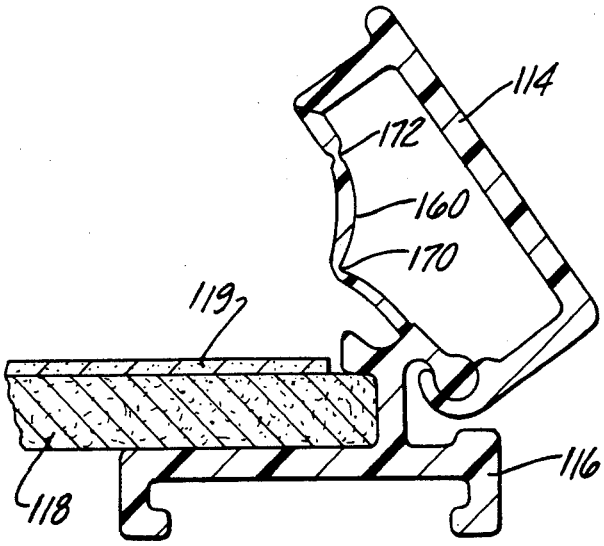

At some point at or near the frame's open position, biasing portion 160 snaps into an outwardly bowed position, as shown in FIG. 15. Living hinges 170 and 172 coact to facilitate the outward snapping action. In the outwardly bowed position, biasing portion 160 exerts forces tending to hold front portion 114 in its relatively open position, thereby permitting poster 119 or the like to be positioned within the frame.

Figure 16:
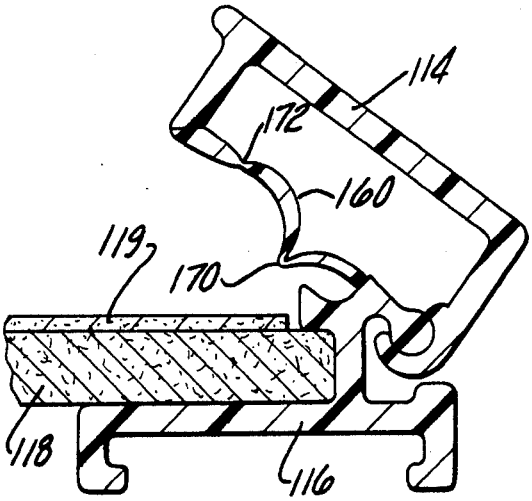
Figure 17:
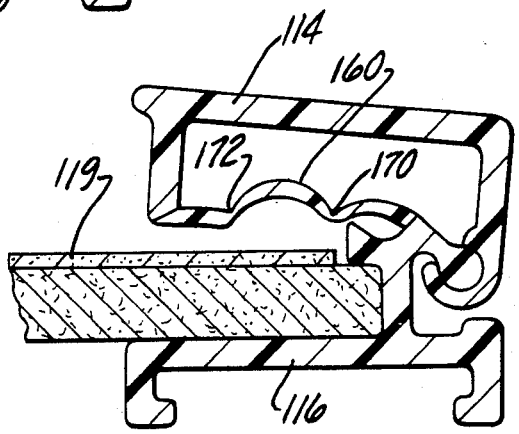
Figure 18:
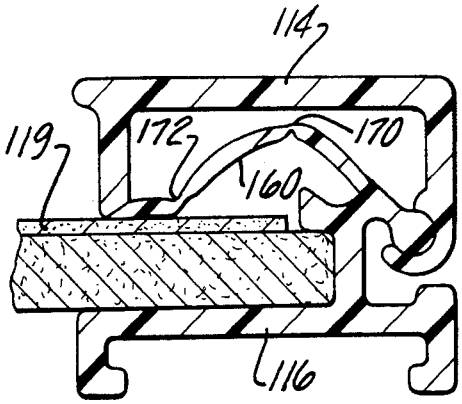

The closing sequence is shown in FIGS. 16 through 18. As the front portion 114 is manually rotated towards the closed position against the biasing forces, biasing portion 160 becomes compressed as seen in FIG. 16. Further rotation towards the closed position, shown in FIG. 17, causes more significant compression of biasing portion 160. In FIG. 17 it will be seen that biasing portion 160 becomes somewhat M-shaped or cydloidal in longitudinal cross section. At some point at or near the final closed position, shown in FIG. 18, biasing portion 160 snaps back into its inwardly bowed position facilitated by hinges 170 and 172. When this occurs the biasing forces produced by biasing portion 160 tend to hold the frame in its closed position, thereby clamping poster 119 in place.

Figure 19:
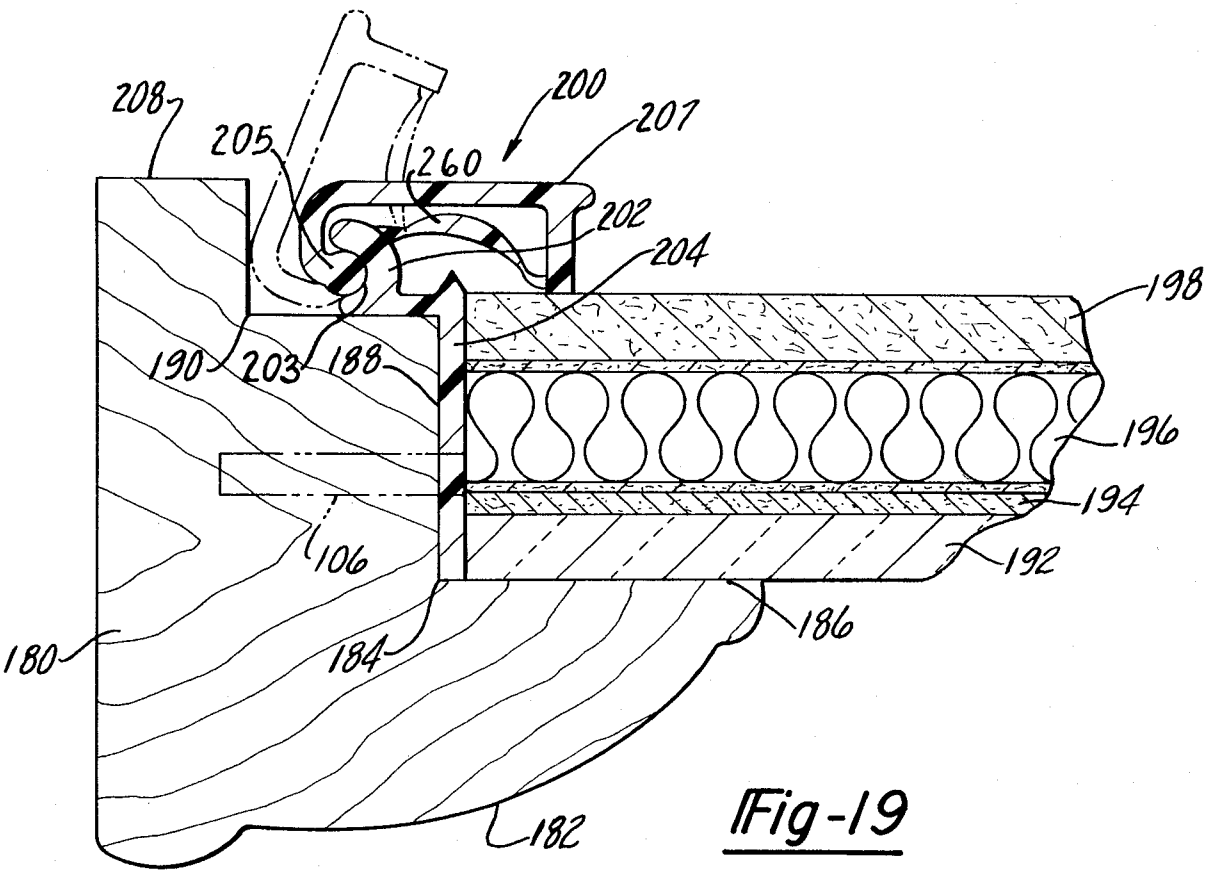
FIG. 19 is a cross sectional view of a back-loading embodiment of the invention.

In the above described embodiments, the poster frame invention serves as a front loading poster frame, and the outer surfaces 15 of front portions 14 can be made decorative to improve the appearance of the poster frame. In an alternative, back-loading embodiment shown in FIG. 19, the poster frame of the invention serves to clamp the display piece in place from the backside of the display piece against a separate frame member. Referring to FIG. 19, the separate frame member 180, shown in cross section, may be formed with a shaped or decorative outwardly facing front surface 182 to improve the appearance of the frame. Frame member 180 may be fashioned from conventional picture frame stock, in a wide variety of materials, including wood, plastic, and metal. Frame member 180 is routed or formed to include a first rabbet 184 defining a holding surface 186 in a plane parallel to and adjacent the display piece, and a securing surface 188 generally perpendicular thereto. A second rabbet 190 is routed or formed in the frame member 180 rearwardly of and generally in stair step relation to rabbet 184. Generally speaking rabbet 184 provides a means for attaching the poster frame clamping member of the invention to the frame member 180 and also receives and holds the display piece while rabbet 190 provides clearance space in which clamping member 200 is partially disposed. As used herein, it will be understood that the display piece may comprise a picture, poster 194 or the like, and in certain applications may also include a protective glass or clear plastic layer 192, sandwiched against picture or poster 194, which in turn may be sandwiched against a layer of corrugated material 196. A rigid backing member 98 is sandwiched behind corrugated material 96 which serves to distribute the clamping forces generated by the spring loaded poster frame member 200 against the display piece, thereby clamping the display piece firmly in place against holding surface 186.

The spring loaded poster frame member or clamping member 200 may be constructed generally according to any of the above-described front loading embodiments with the following modifications. With reference to FIG. 19 it will be seen that section 202 (the counterpart of section 12 in the front loading embodiment) includes a right angular flange 204 or other means used to secure member 200 to member 180, as by stapling with staples 106 into surface 188. In addition section 202 includes cup-shaped formation 203 for pivotal engagement with pintle formation 205 formed on section 207. Section 207 (the counterpart of section 10 in the front loading embodiment) includes bias portion 260 which may include living hinges intermediately along the length thereof according to the embodiment illustrated in FIGS. 11 through 18. In the alternative clamping member 200 may be constructed so that cup-shaped formation 203 is disposed on section 207 and pintle formation 205 is formed on section 202.

In operation, member 200 functions substantially the same as was illustrated and described in connection with FIGS. 5 through 10 or FIGS. 13 through 18. Poster frame member 200 may be opened to allow the display piece and backing member or members to be removed and replaced. Member 200 may then be snapped shut to clamp the display piece in place, whereupon section 207 is either flush with or slightly recessed with respect to the backside 208 of member 180. The entire frame assembly may then be hung on a wall, or attached to some other securing surface.

Figure 20:
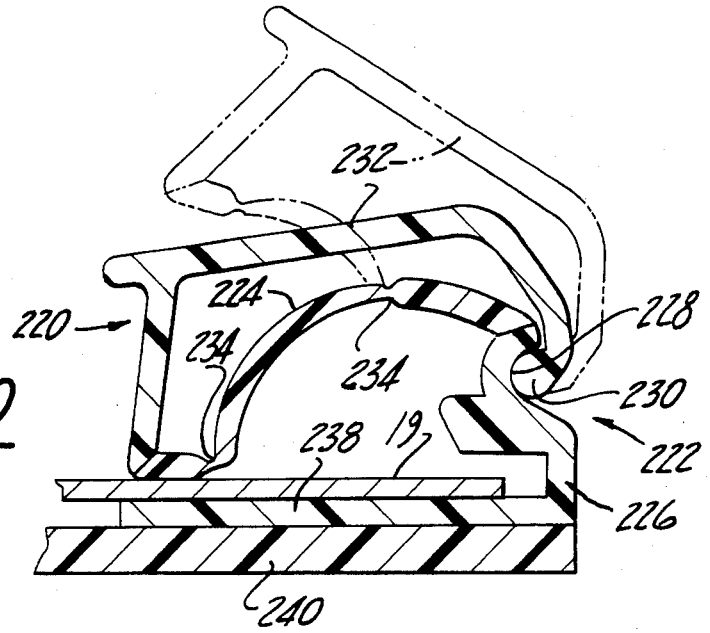
FIG. 20 is a cross-sectional view of still a further embodiment of the invention.

Another embodiment of the invention is shown in FIG. 20. This frame section embodiment 220 has an upper member 232, a lower member 238 and employs the pivoting hinge mechanism 222 of the embodiment shown in FIG. 19 and the bias portion 224 with living hinges of the embodiment shown in FIGS. 11–18. The lower member 238 has a flange 226 which incorporates a cup-shaped formation 228 for mating and pivotal engagement with pintle formation 230 formed on upper member 232. It is thought that having the pintle-and-cup structure made in the manner shown in FIG. 20 (and FIG. 19), rather than the pintle-and-cup structure of FIGS. 2 and 4–18, would minimize any possible interference of adjacent frame members 220 in the mitred corners and would also create some savings in material costs (due to use of less material in such formation).

The embodiment 220 employs a bias portion 224 which preferably includes living hinges 234 intermediately along the length thereof in a similar manner to the embodiment illustrated in FIGS. 11–18. The materials used for the member 232 and 238 and for the bias portion 224 are the same as those described above with reference to FIGS. 11–18. In this regard, the members 232 and 238 are preferably made of rigid polyvinyl chloride and the bias portion 224 is preferably made of estane polyurethane, although the invention is not limited to these particular materials.

Figure 20A:
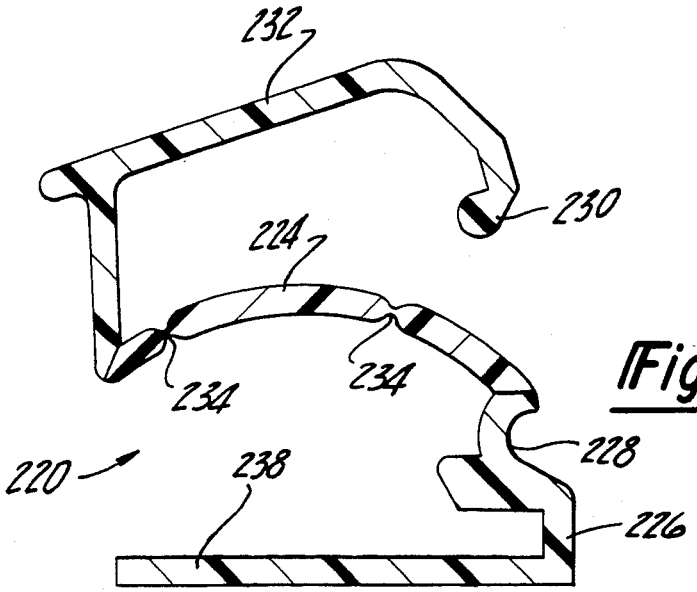
FIG. 20*a* is a cross-sectional view of the embodiment of FIG. 20 showing hinge members disassembled.

When the embodiment 220 is produced, it preferably is extruded in the shape shown in FIG. 20*a* and then assembled and snapped together to form the cross-sectional shape shown in FIG. 20. (This is similar to the manner in which the frame sections shown in FIGS. 2*g* and 12 are extruded). The lower member 238 of frame section 220 is preferably flat and thus adapted to be secured to a frame backing member 240. If the backing member 240 is made of a plastic-type material similar to the frame section 220, then the frame sections forming the frame can be secured thereto by ultrasonically welding. In this manner, no corner keys, braces or the like are needed to secure the frame sections together and a more aesthetically pleasing frame as viewed from the back can be secured. By eliminating the corner braces, a less expensive construction is also possible.

In operation, the embodiment 220 functions substantially the same as was illustrated and described in connection with FIGS. 5–10 or FIGS. 13–18 and does not have to be repeated here in detail. In general poster frame section 220 may be opened to allow the display piece (and backing member or members if appropriate) to be removed and replaced. Member 220 is then snapped shut to clamp the display piece in place.

While a specific embodiment of the invention has been illustrated and described, it will be understood that this embodiment is provided by way of example only and that the invention is not to be construed as being limited thereto, but only by the scope of the following claims.

What is claimed is:

1. A closure comprising:

a first member, a second member rotatable about an axis and movable with respect to said first member between relatively open and relatively closed positions, and resilient articulated biasing means integrally attached to both said first member and said second member for connecting them together, said resilient articulated biasing means including at least one living hinge means at a position between the integral points of attachment to said first member and said second member, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrusion, said first and second members comprising relatively rigid material and said biasing means comprising a relatively softer material and being elastic and resilient, said biasing means providing a force urging said second member toward said closed position.

2. The closure according to claim 1 wherein said first member, said second member and said biasing means are all made from the same plastic material.

3. The closure according to claim 1 wherein said biasing means is made from a different plastic material than said first member.

4. The closure according to claim 1 wherein said first member and said second member are provided with integral and mating hinge formations, said first member and said second member being assembled together in pivotal relationship.

5. The closure according to claim 1 wherein said first member and said second member are each attached to said biasing means at one position and rotatably attached together at another position.

6. The closure according to claim 1 wherein said biasing means provides a first biasing force when said second member is in said closed position and a second biasing force when said second member is in said open position.

7. The closure according to claim 6 wherein said first biasing force is an over-center force and said biasing means is bowed toward said second member.

8. The closure according to claim 6 wherein said second biasing force is directed to urge said second member toward said open position.

9. The closure according to claim 6 wherein said second biasing force is an over-center force and said biasing means is bowed away from said second member.

10. The closure according to claim 1 wherein said biasing means provides alternating over-center forces.

11. The closure according to claim 1 wherein said biasing means provides a plurality of alternatively selectable over-center forces, one of said over-center forces being directed to urge said second member toward said closed position and another of said over-center forces being directed to urge said second member toward said open position.

12. The closure according to claim 1 further comprising means for holding a display piece generally between said first and second members.

13. A display holder for receiving a display piece comprising:

a first member, a second member rotatable about an axis and movable with respect to said first member between relatively open and relatively closed positions, resilient articulated biasing means integrally attached to both said first member and said second member for connecting them together, and means for holding said display piece, said resilient articulated biasing means including at least one living hinge means disposed at an intermediate position thereon, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrustion, said first and second members comprising relatively rigid material and said biasing means comprising relatively softer material and being elastic and resilient, said biasing means providing a force urging said second member toward said closed position.

14. The display holder according to claim 13 wherein said first member, said second member and said biasing means are made from the same plastic material.

15. The display holder according to claim 13 wherein said biasing means is made from a different plastic material than said first member.

16. The display holder according to claim 13 wherein said first member and said second member are provided with integral and mating hinge formations, said first member and said second member being assembled together in pivotal relationship.

17. The display holder according to claim 13 wherein said first member and said second member are each attached to said biasing member at one position and rotatably attached together at another position.

18. The display holder according to claim 13 wherein said biasing means provides a first biasing force when said second member is in said closed position, and a second biasing force when said second member is in said open position.

19. The display holder according to claim 18 wherein said first biasing force is an over-center force and said biasing means is bowed toward said second member.

20. The display holder according to claim 18 wherein said second biasing force is in a direction urging said second member toward said open position.

21. The display holder according to claim 18 wherein said second biasing force is an over-center force and said biasing means is bowed away from said second member.

22. The display holder according to claim 13 wherein said biasing means provides alternating over-center forces.

23. The display holder according to claim 13 wherein said biasing means provides a plurality of alternatively selectable over-center forces, one of said over-center forces being directed to urge said second member toward said closed position and another of said over-center forces being directed to urge said second member toward said open position.

24. The display holder according to claim 13 wherein said means for holding said display piece is defined by at least one of said first and second members.

25. The display holder according to claim 13 wherein said means for holding said display piece comprises a relatively softer material than said second member.

26. The display holder according to claim 13 further comprising a backing member secured to said first member.

27. The display holder according to claim 13 wherein said first member, said second member and said biasing means comprise a frame section for assembly with a plurality of other frame sections to form a polygonal frame structure.

28. A closure comprising:

a first member, a second member, hinge means for defining an axis and pivotally connecting said first and second members, said second member being movable with respect to said first member between relatively open and relatively closed positions, and resilient articulated biasing means integrally attached to both said first member and said member for connecting them together, said resilient articulated biasing means including at least one living hinge means disposed at an intermediate position thereon, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrusion, said first and second members comprising relatively rigid material and said biasing means comprising a relatively softer material and being elastic and resilient, said biasing means providing a force urging said second member toward said closed position.

29. The closure according to claim 28 wherein said first member, said second member and said biasing means are all made from the same plastic material.

30. The closure according to claim 28 wherein said biasing means is made from a different plastic material than said first member.

31. The closure according to claim 28 wherein said first member and said second member are provided with integral and mating hinge formations, said first member and said second member being assembled together in pivotal relationship.

32. The closure according to claim 28 wherein said first member and said second member are each attached to said biasing means at one position and rotatably attached together at another position.

33. The closure according to claim 28 wherein said biasing means provides a first biasing force when said second member is in said closed position and a second biasing force when said second member is in said open position.

34. The closure according to claim 33 wherein said first biasing force is an over-center force and said biasing means is bowed toward said second member.

35. The closure according to claim 33 wherein said second biasing force is directed to urge said second member toward said open position.

36. The closure according to claim 33 wherein said second biasing force is an over-center force and said biasing means is bowed away from said second member.

37. The closure according to claim 28 wherein said biasing means provides alternating over-center forces.

38. The closure according to claim 28 wherein said biasing means provides a plurality of alternatively selectable over-center forces, one of said over-center forces being directed to urge said second member toward said closed position and another of said over-center forces being directed to urge said second member toward said open position.

39. The closure according to claim 28 further comprising means for holding a display piece generally between said first and second members.

40. A display holder for receiving a display piece comprising:

a first member, a second member, hinge means for defining an axis and pivotally connecting said first and second members, said second member being movable with respect to said second member between relatively open and relatively closed positions, resilient articulated biasing means integrally attached to both said first member and said second member for connecting them together, and means for holding said display piece, said resilient articulated biasing means having at least one living hinge means disposed at an intermediate position thereon, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position.

41. The display holder according to claim 40 wherein said first member, said second member and said biasing means are made from the same plastic material.

42. The display holder according to claim 40 wherein said biasing means is made from a different plastic material than said first member.

43. The display holder according to claim 40 wherein said first member and said second member are provided with integral and mating hinge formations, said first member and said second member being assembled together in pivotal relationship.

44. The display holder according to claim 40 wherein said first member and said second member are each attached to said biasing member at one position and rotatably attached together at another position.

45. The display holder according to claim 40 wherein said biasing means provides a first biasing force when said second member is in said closed position, and a second biasing force when said second member is in said open position.

46. The display holder according to claim 45 wherein said first biasing force is an over-center force and said biasing means is bowed toward said second member.

47. The display holder according to claim 45 wherein said second biasing force is in a direction urging said second member toward said open position.

48. The display holder according to claim 45 wherein said second biasing force is an over-center force and said biasing means is bowed away from said second member.

49. The display holder according to claim 40 wherein said biasing means provides alternating over-center forces.

50. The display holder according to claim 48 wherein said biasing means provides a plurality of alternatively selectable over-center forces, one of said over-center forces being directed to urge said second member toward said closed position and another of said over-center forces being directed to urge said second member toward said open position.

51. The display holder according to claim 40 wherein said means for holding said display piece is defined by at least one of said first and second members.

52. The display holder according to claim 40 wherein said means for holding said display piece comprises a relatively softer material than said second member.

53. The display holder according to claim 40 further comprising a backing member secured to said first member.

54. The display holder according to claim 40 wherein said first member, said second member and said biasing means comprise a frame section for assembly with a plurality of other frame sections to form a polygonal frame structure.

55. A closure comprising:

a first member, a second member rotatable about an axis and movable with respect to said first member between relatively open and relatively closed positions, and resilient biasing means integrally attached by a first portion thereof to said first member and integrally attached by a second portion thereof to said second member, said biasing means forming hinged joint disposed between said first and second portions, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrusion, said first and second members comprising relatively rigid material and said biasing means comprising relatively softer material and being elastic and resilient, said biasing means providing a plurality of alternatively selectable over-center forces, one of said forces urging said second member toward said closed position and another of said forces urging said second member toward said open position.

56. The closure of claim 55 wherein said hinged joint is a living hinge.

57. The closure of claim 55 wherein said hinged joint is disposed in a first spatial relationship with respect to said first and second portions of said biasing means when said second member is in said closed position, and disposed in a second spatial relationship with respect to said first and second portions of said biasing means when said second member is in said open position.

58. The closure of claim 55 wherein said first and second portions of said biasing means lie in a common plane and said hinged joint forming means is disposed above said plane when said second member is in said closed position and disposed below said plane when said second member is in said open position.

59. The closure of claim 55 wherein said one of said forces urges said hinged joint forming means into said disposition above said plane, and said another of said forces urges said hinged joint forming means into said disposition below said plane.

60. A display holder for receiving a display piece comprising:

a first member, a backing member secured to said first member, a second member movable with respect to said first member between relatively open and relatively closed positions, resilient articulated biasing means integrally attached to both said first member and said second member for connecting them together, and means for holding said display piece, said resilient articulated biasing means including at least one living hinge means disposed at an intermediate position thereon, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position.

61. A display holder for receiving a display piece comprising:

a first member, a second member movable with respect to said first member between relatively open and relatively closed positions, resilient articulated biasing means integrally attached to both said first member and said second member for connecting them together, and means for holding said display piece, said resilient articulated biasing means including at least one living hinge means disposed at an intermediate position thereon, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position, and wherein said first member, said second member and said biasing means comprise a frame section for assembly with a plurality of other frame sections to form a polygonal frame structure.

62. A display holder for receiving a display piece comprising:

a first member, a backing member secured to said first member, a second member, hinge means for pivotally connecting said first and second members, said second member being movable with respect to said second member between relatively open and relatively closed positions, resilient articulated biasing means integrally attached to both said first member and said second member for connecting them together, and means for holding said display piece, said resilient articulated biasing means having at least one living hinge means disposed at an intermediate position thereon, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position.

63. A display holder for receiving a display piece comprising:

a first member, a second member, hinge means for pivotally connecting said first and second members, said second member being movable with respect to said second member between relatively open and relatively closed positions, resilient articulated biasing means integrally attached to both said first member and said second member for connecting them together, and means for holding said display piece, said resilient articulated biasing means having at least one living hinge means disposed at an intermediate position thereon, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position, and wherein said first member, said second member and said biasing means comprise a frame section for assembly with a plurality of other frame sections to form a polygonal frame structure.

64. A closure comprising:

a first member, a second member movable with respect to said first member between relatively open and relatively closed positions, and resilient biasing means integrally attached by a first portion thereof to said first member and integrally attached by a second portion thereof to said second member, said biasing means forming hinged joint disposed between said first and second portions, said first member, said second member and said biasing means being made of extruded plastic material and being integrally formed together at the time of extrusion, said first and second members comprising relatively rigid material and said biasing means comprising a relatively softer material and being elastic and resilient, said biasing means providing a plurality of alternatively selectable over-center forces, one of said forces urging said second member toward said closed position and another of said forces urging said second member toward said open position, and wherein said first and second portions of said biasing means lie in a common plane and said hinged joint forming means is disposed above said plane when said second member is in said closed position and disposed below said plane when said second member is in said open position.

65. A closure comprising:

a first member, a second member movable with respect to said first member between relatively open and relatively closed positions, and resilient biasing means integrally attached by a first portion thereof to said first member and integrally attached by a second portion thereof to said second member, said biasing means forming hinged joint disposed between said first and second portions, said first member, said second member and said biasing means being made of extruded plastic material and being integrally formed together at the time of extrusion, said first and second members comprising relatively rigid material and said biasing means comprising a relatively softer material and being elastic and resilient, said biasing means providing a plurality of alternatively selectable over-center forces, one of said forces urging said second member toward said closed position and another of said forces urging said second member toward said open position, and wherein said one of said forces urges said hinged joint forming means into said disposition above said plane, and said another of said forces urges said hinged joint forming means into said disposition below said plane.

66. A display holder for receiving a display piece comprising:

a first member, a second member hingedly secured by a first living hinge to said first member for rotation about an axis, said second member being movable with respect to said first member between relatively open and relatively closed positions, resilient articulated biasing means integrally attached to both said first member and said second member for connecting them together, and means for holding said display piece, said resilient articulated biasing means including a second living hinge disposed at an intermediate position thereon and further including a third living hinge disposed at an end thereof opposite said first living hinge, said first member and said second member defining a longitudinal dimension parallel to said axis and said biasing means being fully coextensive with said longitudinal dimension and said biasing means being substantially enclosed by said first and second members when disposed in said closed position, said first member, said second member and said biasing means being made of extruded plastic material and being integrally formed together at the time of extrustion, said first and second members comprising a relatively rigid first material and said biasing means comprising a relatively softer second material different from said first material and being elastic and resilient, said biasing means providing a force urging said second member toward said closed position.

* * * * *

UNITED STATES PATENT AND TRADEMARK OFFICE

CERTIFICATE OF CORRECTION

PATENT NO. : 4,512,094

DATED : April 23, 1985

INVENTOR(S) : James R. Seely

It is certified that error appears in the above-identified patent and that said Letters Patent is hereby corrected as shown below:

| | | |
|---|---|---|
| Column 4, | line 29, | "36" should be --30-- |
| Column 6, | line 16, | "employes" should be --employs-- |
| Column 7, | line 45, | "14" should be --114-- |
| Column 10, | line 57, | "mitred" should be --mitered-- |
| Column 10, | line 64, | "member" should be --members-- |
| Column 12, | line 56, Claim 13, | "extrustion" should be --extrusion-- |
| Column 13, | line 60, Claim 28, | insert --second-- after "said", second occurrence |
| Column 15, | line 56, Claim 50, | "48" should be --40-- |
| Column 16, | line 57, Claim 59, | "55" should be --58-- |
| Column 20, | line 22, Claim 66, | "extrustion" should be --extrusion-- |

Signed and Sealed this

*Eighth* Day of *April 1986*

[SEAL]

*Attest:*

DONALD J. QUIGG

*Attesting Officer*

*Commissioner of Patents and Trademarks*